United States Patent [19]

Comeau et al.

[11] Patent Number: 4,495,671

[45] Date of Patent: Jan. 29, 1985

[54] MASTER CARRIER AND PERFORATED TAPE DRIVE COMBINATION

[75] Inventors: Paul E. Comeau, Warwick; Anthony Torti, Cranston, both of R.I.

[73] Assignee: Kenney Manufacturing Company, Warwick, R.I.

[21] Appl. No.: 447,268

[22] Filed: Dec. 6, 1982

[51] Int. Cl.[3] ..... A74H 5/032

[52] U.S. Cl. ..... 16/87 R; 16/87.4 R; 16/95 D

[58] Field of Search ..... 16/87.2, 87.4 R, 87 R, 16/93 R, 91, 93 D, 94 D, 95 D, 96 D, 98, 102, 106, DIG. 31, 87.6 R, 87.8, 97, 101; 160/126, 330; 74/37, 27, 89.2, 89.21

[56] References Cited

U.S. PATENT DOCUMENTS

| | | | |
|---|---|---|---|
| 885,864 | 4/1908 | Read . | |
| 2,040,934 | 5/1936 | Gillen | 74/37 |
| 2,179,763 | 11/1939 | Smolowitz | 160/107 |
| 2,792,560 | 5/1957 | Bollmeier | 339/67 |
| 3,121,453 | 2/1964 | Modrey | 151/41.7 |
| 3,243,755 | 3/1966 | Johnston | 339/47 |
| 3,362,462 | 1/1968 | Rosenbaum | 16/87.4 R X |
| 3,698,035 | 10/1972 | Salzmann | 16/95 D |
| 4,064,648 | 12/1977 | Cany | 16/87 R X |

FOREIGN PATENT DOCUMENTS

| | | | |
|---|---|---|---|
| 1274739 | 9/1961 | France . | |
| 1430120 | 12/1966 | France | 16/93 D |
| 942835 | 11/1963 | United Kingdom . | |
| 583498 | 12/1977 | U.S.S.R. . | |

OTHER PUBLICATIONS

Heli-Coil Products ad, IMPO, Jan. 1983, p. 7.

*Primary Examiner*—Fred Andrew Silverberg
*Attorney, Agent, or Firm*—Robert B. Russell

[57] ABSTRACT

Adjustable telescoping drapery traverse rods are provided with positive drive means for master carriers comprising an essentially non-stretchable perforated drive tape and toothed drive-sprocket. Apparatus is also provided for adjusting the points of connection between the master carriers and the tape from the outside of the rod after the length of the rod has been adjusted to fit a given window (or the like) opening.

2 Claims, 7 Drawing Figures

10
12
14
18
20
22
24
26
28
30
32
34
36
38
40
42
44
46
50
54

MASTER CARRIER AND PERFORATED TAPE DRIVE COMBINATION

FIELD OF THE INVENTION

This invention relates to drapery hardware and more particularly to adjustable telescoping traverse rods for curtains. Still more particularly it relates to a drive-tape and master carrier combination for such rods especially of the motor-driven type.

BACKGROUND OF THE INVENTION

Motor-driven traverse rods have been on the market for many years. In one form, a pair of master carriers is driven between the opened and closed positions by means of a double acting worm gear which is turned by a motor mounted at the end of the rod. Limit switches serve to interrupt the action of the motor when the master carriers reach the designed extremity of their travel. In another form, a small motor is carried by each of the master carriers. In still another form the master carriers are driven along the rod by eddycurrent forces. Each of these prior art devices has serious drawbacks. They are all expensive and none is adapted for convenient use with adjustable telescoping rods of the type which can be installed by the usual retail customer. As a result, motor-driven traverse rods have not gone into extended commercial use, and have been used only in custom made and expensive installations.

A basic objective of this invention is, therefore, to provide a convenient, and inexpensive, drive for the master carriers of a conventional telescoping traverse rod, so as to make such rods suitable for being motor driven, and thereby to make motor driven rods inexpensive enough and convenient enough to be used by the average retail customer. A more specific objective is to provide such a traverse rod drive mechanism which will, at one and the same time, positively drive the master carriers (as is required), and be adjustable by simple means from the exterior of the rod, so that an average retail customer can adjust the length of a motor-driven traverse rod.

BRIEF DESCRIPTION OF THE INVENTION

In the accomplishments of these and other objects of the invention in a preferred embodiment, I employ a conventional traverse rod in which the rod comprises a pair of telescoping, inverted U-shaped tubes mounted on a wall by means of suitable brackets. The tubes are slotted and a first and second master carrier, as well as numerous idler carriers, are mounted to slide longitudinally of the rod in the slot. Such rods can be readily installed and adjusted to fit varying window widths by the usual retail customer.

To drive the master carriers, I provide a flexible, perforated, essentially non-stretchable drive tape which extends from end-to-end within the rod in the form of a loop. Pulleys are provided at each end of the rod and the tape loop passes around them with the ends of the loop terminating at the first carrier. At one end of the rod the tape also passes around a toothed sprocket, with the teeth of the sprocket fitting, in positive driving relation into the perforations in the tape. Adjustable means accessible from the outside of the rod, are provided for securing the ends of the tape loop to the first carrier so that the length of the rod can be adjusted and, thereafter, all substantial slack can be removed from the tape loop. Within the rod, the other leg of the tape loop is secured to the second master carrier at the point on tape loop which corresponds to the fully opened position of the second master when the first master is in the fully opened position. The sprocket is driven from the outside by a motor or other drive mechanism to control the position of the master carriers.

The main features of the invention are that it is simple, easily adjustable, and inexpensive while at the same time providing the secure positive drive which is essential for the successful operation of motor-driven traverse rods. It makes possible the combination of an inexpensive motor drive with a conventional traverse rod and thereby makes available for the first time an inexpensive and adjustable motor-driven traverse rod to the usual retail customer.

BRIEF DESCRIPTION OF THE DRAWINGS

A preferred embodiment of the invention selected for purposes of illustration only is depicted in the accompanying drawings in which.

DETAILED DESCRIPTION OF THE INVENTION

Figures 1, 2:
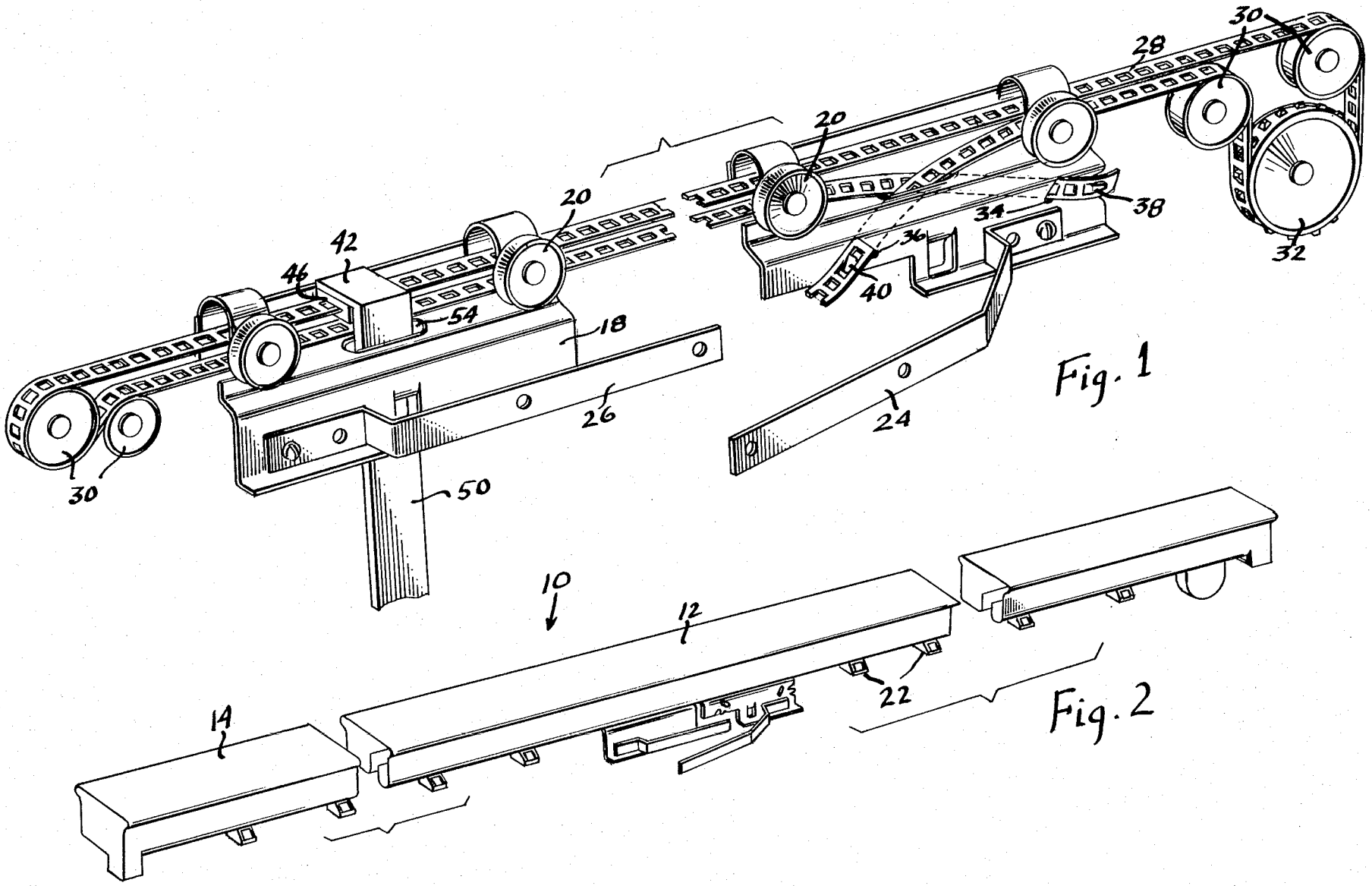
FIG. 1 is a perspective view showing the operative components of the inventive tape-drive and master carrier combination.
FIG. 2 is a perspective view of a typical telescoping traverse rod suitable for use with the invention.
Figure 5:
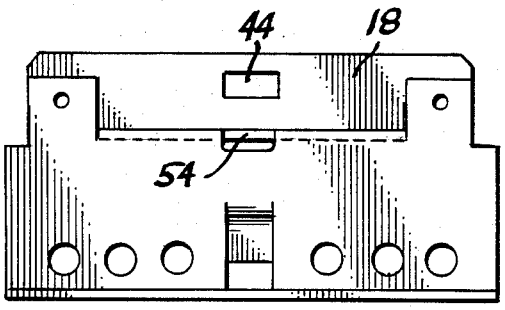
FIG. 5 is a side view of the base plate of the second master carrier.
Figure 6:
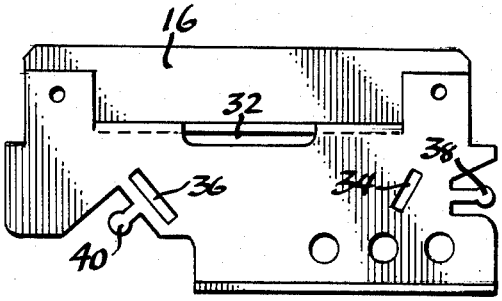
FIG. 6 is a side view of the base plate of the first master carrier.
Figure 7:
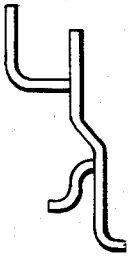
FIG. 7 is a view in end elevation of the base plate of the second master carrier.
Figure 3:
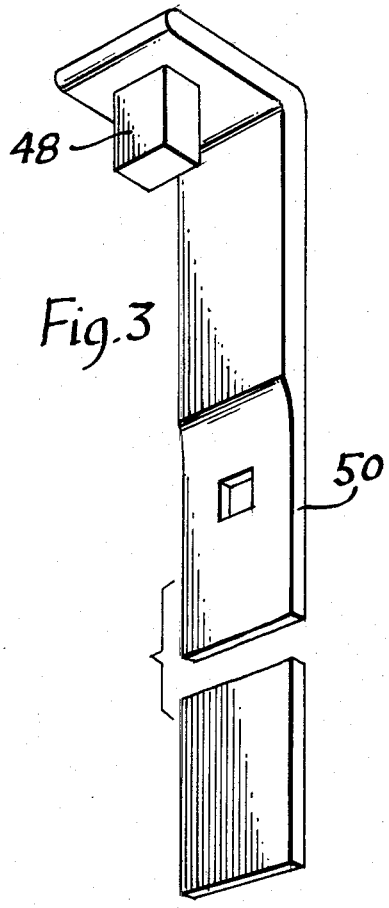
FIG. 3 is a view in perspective of the movable portion of the locking means employed with the second master carrier.
Figure 4:
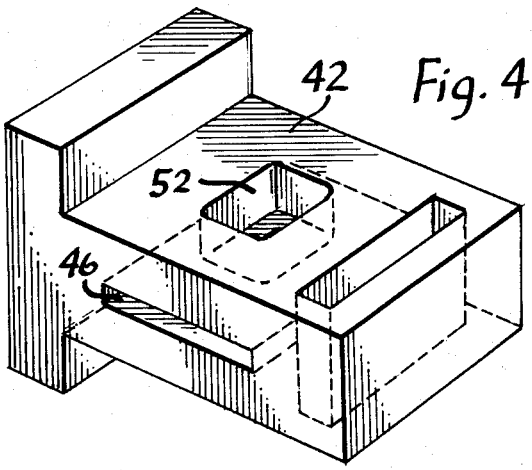
FIG. 4 is a view in perspective of the stationary portion of the locking means employed with the second master carrier.

The preferred embodiment of the invention herein shown is adapted for use with a conventional traverse rod indicated generally at 10 and including telescoping tubes 12 and 14. As shown, the tubes are of the inverted U-shaped construction having upstanding tracks within and flanking the slot in the U. First and second master curtain carriers 16 and 18 respectively each equipped with double pairs of guide rollers 20 are adapted for longitudinal movement within the rod. Idler curtain carriers 22 are also arranged for movement along the rod 10. Overlapping curtain supporting arms 24 and 26 are respectively secured to carriers 16 and 18 in the conventional manner to guide the curtain halves into overlapping relation when the master carriers are in the closed (i.e., abutting) position.

The relative position of the master carriers within the rod is controlled by a perforated, essentially non-stretchable, drive tape 28 which is in the form of a loop within rod 10 and arranged to pass around pulleys 30 at each end of the rod. At one end of the rod the tape also passes around a sprocket 32. Sprocket 32 has spaced teeth which fit into the perforations in tape 28 which are equally spaced, thereby linking the sprocket and drive-tape in a positive-drive relationship. A motor or other suitable exterior driving means (not shown) drives the sprocket.

The tape loop 28 has an upper leg which extends from end to end of the rod and a lower leg which terminates at the first master carrier 16 where both ends pass through a perforation 32 in opposite directions, then respectively through slots 34 and 36 and hook over externally exposed locking prongs 38 and 40 respectively. In this way, when the rod is being installed, the tape 28 is not secured to first master 16 and the rod may be telescoped to adjust its length as desired. When the rod is in the correct position of adjustment, the ends of tape 28 are then pulled out sufficiently to remove substantially all slack in the tape and locked over prongs 38 and 40 respectively. Since the perforations are ⅜" apart, and the tape passes over pulleys at the end, the adjustment of the length of the rod is in increments of 3/16" in relation to the tape. This is not, of course, infinite adjustment but sufficient slack in the tape is removed so that smooth, and substantially slack-free operation is provided.

As shown, both ends of the tape 28 are separately adjustable at carrier 16, but it will be understood that one end can be permanently fixed to carrier 16, and the other end only arranged for adjustment.

When the adjustment has been made and the tape ends are secured to the first master carrier 16, any excess tape protruding below the rod can be simply cut off with a knife or scissors.

Both legs of the tape loop 28 pass freely through the second master carrier 18. Once the rod has been adjusted, however, the slack removed, and the tape ends secured to first master carrier 16, it is then appropriate to secure the upper leg of tape loop 28 to the second master carrier 18. This is done by means of a locking guide member 42 which fits into a suitably shaped perforation 44 in carrier 18, with tape 28 sliding freely through an axially aligned hole 46 in locking guide member 42. A locking detent 48 mounted on an inverted L-shaped locking control arm 50 fits down into a hole 52 in guide member 42 and into one of the perforations of tape 28 so as to fix the tape's position relative to second master carrier 18. The locking control arm 50 extends downwardly through hole 54 to an exposed position below second master carrier 18. Thus, second master carrier 18 can be locked to or freed from tape 28 by lifting locking control arm 50 so as to lift locking detent 48 out of engagement with the tape, or lowering control arm 50 so as to engage detent 48 with a perforation in the tape.

In practice the carriers are adjusted relative to each other first by locking the tape to first master carrier 16, then moving first master carrier 16 to its fully opened position with the tape sliding freely of second master carrier 18. Next, the second master carrier 18 is moved to its fully opened position and locked to the tape at that point. This procedure automatically positions the masters, and thereafter moving them to the closed position by operation of the tape brings the curtain halves to the closed position at the centerline of the adjusted traverse rod.

The arrangement is adjustable, compact, self-contained, simple, and certain in the sense that operation of the tape assures concomitant operation of the master carriers. It is, therefore, highly suitable for incorporation with a motor drive arrangement.

Since various modifications of the invention will now be obvious to those skilled in the art, it is not our intention to confine the invention to the precise form herein shown but rather to limit in terms of the appended claims.

We claim:

1. A tape-drive and master carrier combination for telescoping traverse rods for curtains comprising:

(a) a hollow traverse rod including a pair of elongated adjustable telescoping tubes each of a given length adapted to be mounted on a wall;

(b) a first and second master curtain carrier mounted in said rod for longitudinal motion relative thereto from respectively fully opened to fully closed positions, (c) a length of a flexible, uniformly perforated, essentially non-stretchable, drive-tape for said master carriers;

(d) a toothed drive-sprocket for driving said tape with the teeth of said sprocket fitting in positive driving relation into the perforations in said tape;

(e) pulley means at each end of said rod;

(f) said drive-tape in said tubes in the form of a loop passing over the pulley means at each end of said rod, said loop having an upper leg extending the length of said rod and a lower leg formed by two free ends of said loop terminating at said first master carrier;

(g) adjustable means at said first master carrier accessible from outside of said rod for securing said ends of said tape loop to said first master carrier whereby slack may be substantially removed from said loop after telescoping adjustment of the length of said rod has been made;

(h) adjustable means at said second master carrier accessible from the outside of said rod for securing said second master carrier to the upper leg of said tape loop at a point on said upper leg which corresponds to the fully opened position of said second master carrier when the first master carrier is in the first master carrier's fully opened position; the adjustable means (h) at the second master carrier comprising a locking detent mounted on a control arm, means for slidably interconnecting the control arm and the second master carrier so that said locking detent can be placed in locking relation in a perforation in the upper leg of said tape loop, and the control arm extending through the second master carrier to the outside of said rod so that the second master carrier can be locked to the tape by operation of the control arm from the outside of said rod.

2. The tape-drive and master carrier combination defined in claim 1 further characterized by:

the adjustable means (g) at the first master carrier comprising a pair of prongs on said first master carrier positioned and arranged to fit in retaining relation with the ends of said tape with one prong of said pair fitting into a perforation in said tape at one end thereof and with the other prong fitting into a perforation at the other end of said tape, and said prongs being accessible from the outside of said rod.

* * * * *